United States Patent [19]

Williams

[11] 4,292,707

[45] Oct. 6, 1981

[54] FRICTIONAL RETAINER FOR HOLDING A DOOR OPEN

[76] Inventor: Clarence E. Williams, 2122 W. 450 N., LaPorte, Ind. 46350

[21] Appl. No.: 108,586

[22] Filed: Dec. 31, 1979

[51] Int. Cl.[3] ..... E05F 15/20

[52] U.S. Cl. ..... 16/48.5; 16/82

[58] Field of Search ..... 16/48.5, 82

[56] References Cited

U.S. PATENT DOCUMENTS 2,010,937 8/1935 Voight ..... 16/48.5

3,729,770 5/1973 Lasier ..... 16/48.5

FOREIGN PATENT DOCUMENTS 1091801 11/1954 France ..... 16/48.5

*Primary Examiner*—Wayne L. Shedd

*Attorney, Agent, or Firm*—Oltsch, Knoblock & Hall

[57] ABSTRACT

A door in combination with a retainer which uses a frictionally restricted rotating disc to hold the door open. Closing of the door causes the disc to rotate and release the door.

6 Claims, 10 Drawing Figures

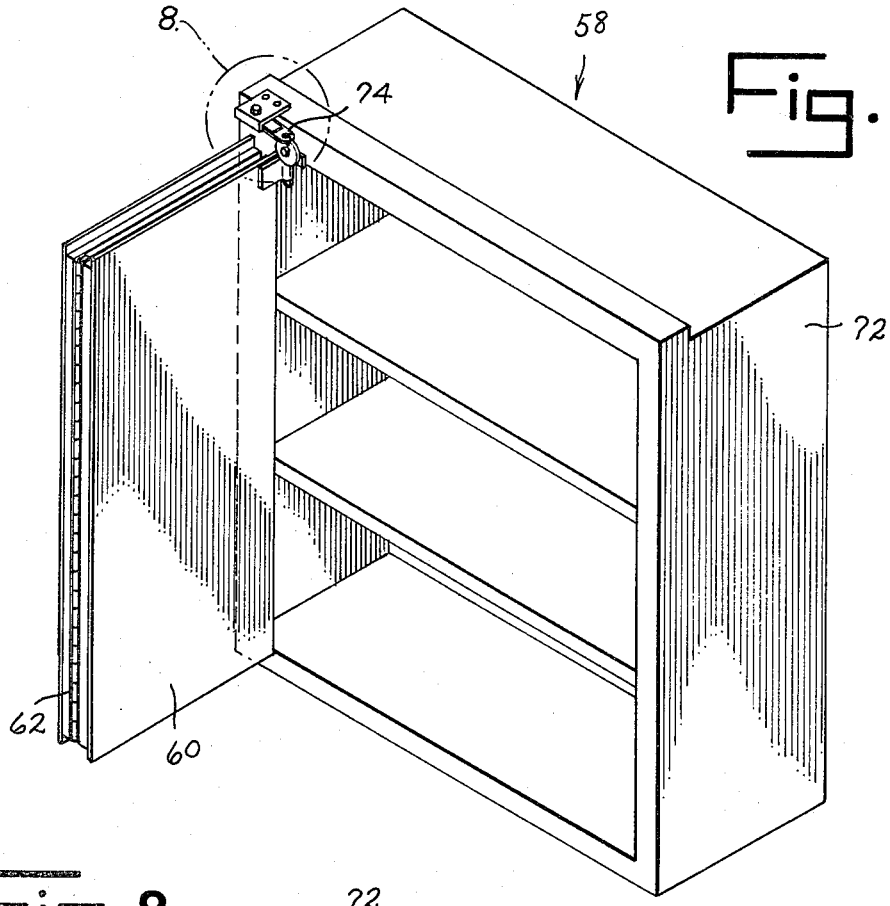
Fig. 7
Fig. 8
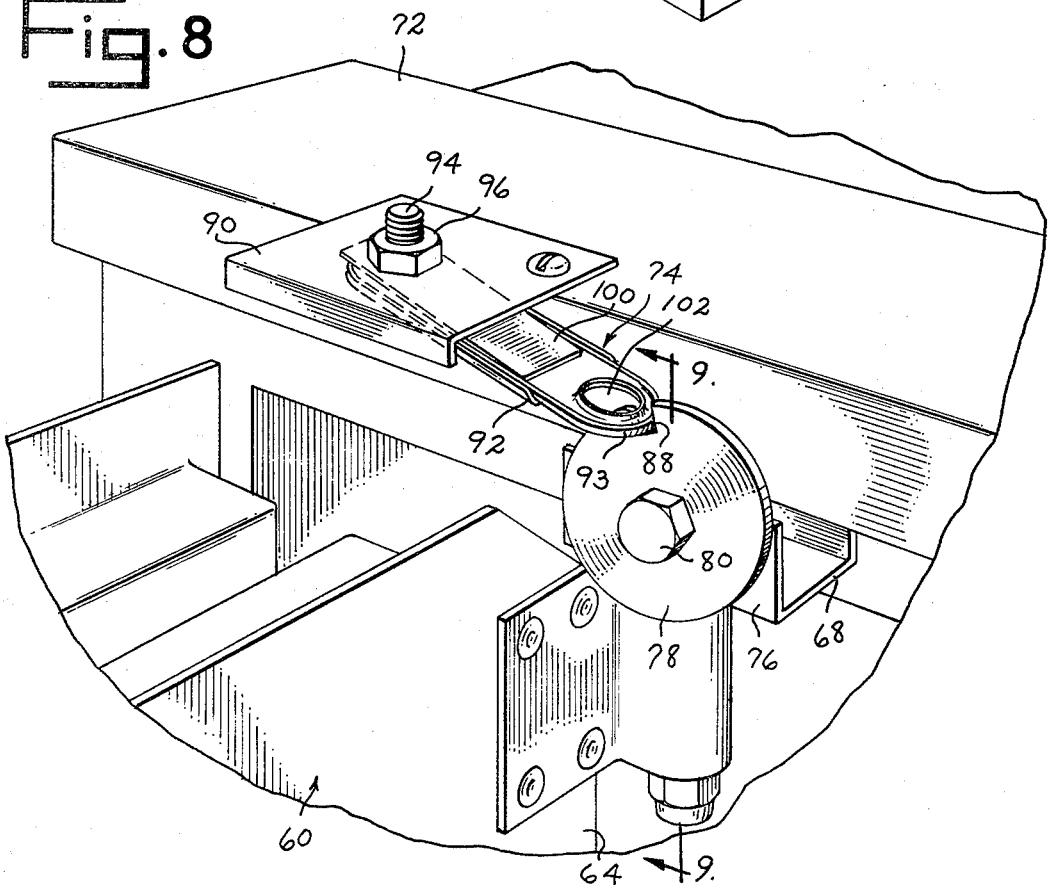

FRICTIONAL RETAINER FOR HOLDING A DOOR OPEN

SUMMARY OF THE INVENTION

This invention relates to a frictional retainer used with a door to maintain the door in its open position.

Previous attempts to hold doors open have included hooks, latches and springs, used singly and in combination. To close the door after securing it in an open position, one had to lift hooks, move latches or release springs.

The present invention requires only a slight pull or push to release the door. The door is maintained in an open position by means of a friction restricted disc. The disc has a notch formed in its edge which interfits with a catch as the door is opened. When the catch and notch meet, further opening of the door causes the disc to rotate. With the door fully opened, the disc is rotated into its frictional retaining position. To close the door, one need only pull or push on the door strong enough to overcome the frictional force upon the disc and allow its rotation to release the catch.

Additionally, a heat fusible link can be used in association with the friction disc. Such a combination can be used in cabinets for the storage of paints, lacquers and other inflammable products. When the ambient temperature about the cabinet rises to an unsafe point, the fusible link will separate and release the door to close, thereby protecting the contents of the cabinet.

Accordingly, it is an object of this invention to provide a means of retaining a door in an open position by means of friction.

Another object of this invention is to provide a retaining member which is used to hold a door open and which can be economically produced.

Another object of this invention is to provide a frictional door retainer which releases either upon pulling of the door or upon the application of heat.

Other objects will become obvious upon a reading of the following description.

BRIEF DESCRIPTION OF THE DRAWINGS

FIG. 7 is a perspective view of a cabinet with the bi-fold door thereof retained in its open position by another embodiment of this invention.

FIG. 8 is an enlarged detail view of the door being held in an open position as seen within broken line circle 8 of FIG. 7.

DESCRIPTION OF THE PREFERRED EMBODIMENTS

Figure 1:
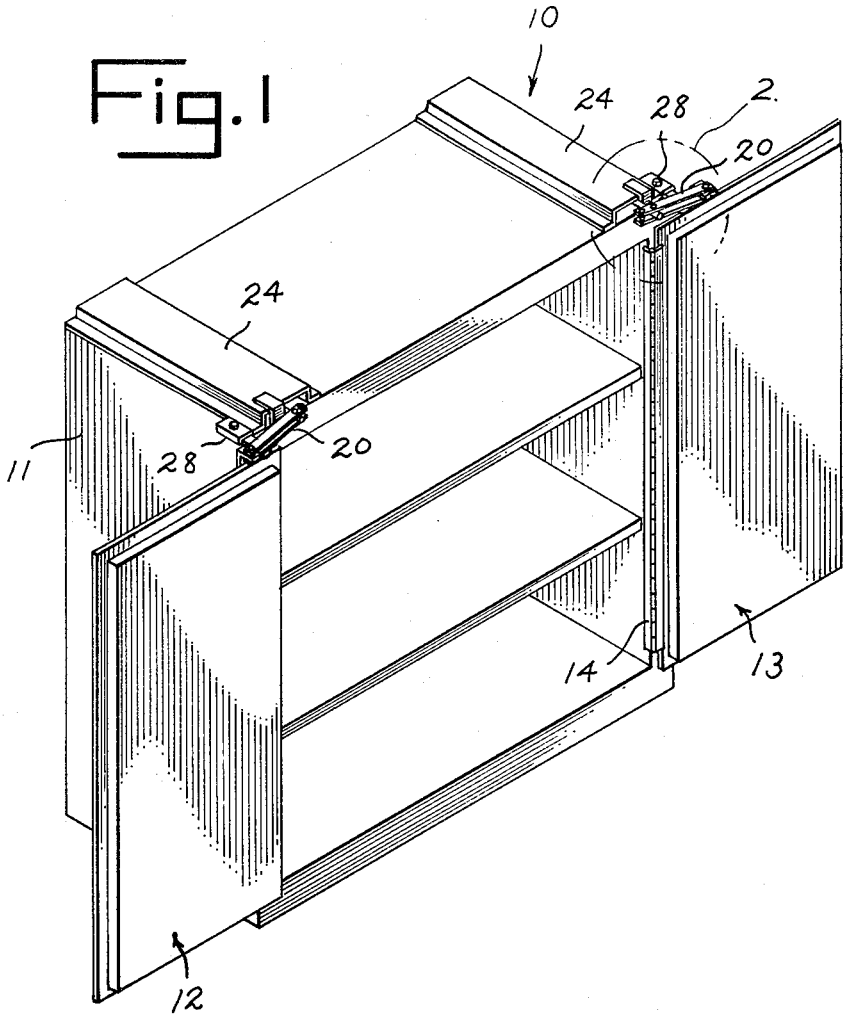
FIG. 1 is a perspective view of a cabinet with doors retained in their opened positions by one embodiment of this invention.

The preferred embodiments illustrated are not intended to be exhaustive or to limit the invention to the precise forms disclosed. They are chosen and described in order to best explain the principles of the invention and its application and practical use to thereby enable others skilled in the art to utilize the invention.

Referring to FIGS. 1-6, cabinet 10 is of the type generally used for the storage of paints, lacquers and other inflammable objects. It is constructed preferably of metal and may be insulated to prevent high temperatures from occurring within the cabinet by an external high heat source, such as a fire. Doors 12, 13 of cabinet 10 are secured to the cabinet frame and housing 11 by means of vertical hinges 14 about which the doors rotate upon opening and closing. A spring-actuated closure 20 is secured between housing 11 and each of doors 12, 13. Each closure 20 includes a cylinder (not shown) located under a cover 24 and a spring biased segmented actuator rod 22. Each closure cylinder is pivotally anchored to the top of cabinet housing 11. The segmented rod 22 of each closure 20 is connected to a bracket 26 which inturn is secured to each of the doors 12 and 13. A stop 30 is carried by each cover 24 for contact with rod 22 of the adjacent closure upon opening and closing movement of its connected door. Closures 20 serve to automatically close the doors 12, 13 and are operationally described in U.S. Pat. No. 4,146,994 incorporated herein by reference.

Figure 2:
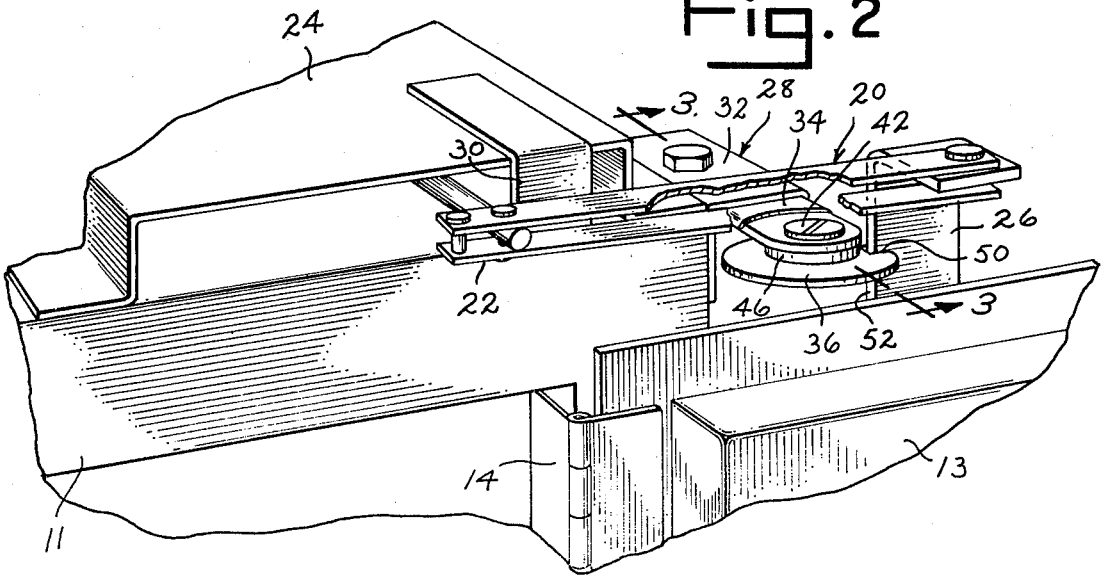
FIG. 2 is an enlarged detail view of a door being held in an open position as seen within broken line circle 2 of FIG. 1.
Figure 3:
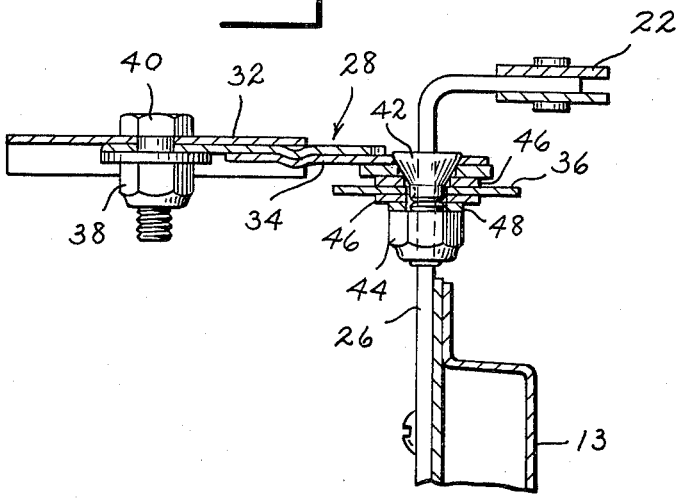
FIG. 3 is a cross-sectional view through line 3—3 of FIG. 2.

A retainer member 28 extends between each door 12,13 and cabinet housing 11. Each retainer member 28 includes a bracket 32 which is connected to housing 11 near the hinge 14 of the adjacent door 12,13 preferably at the general level of the upper edge of the door. Bracket 32 includes a fusible link part 34 to which a rotatable disc 36 is pivotally connected. Link part 34 is secured to the remainder of the bracket 32 by a nut 38 and bolt 40 to enable it to be replaced when necessary and consists of parts which separate when subjected to a specific amount of heat. Disc 36 is connected to link part 34 by a screw 42 and nut 44 with interdisposed bearing washers 46 and a lock washer 48. Nut 44 is tightened with disc 36 being compressed sufficiently between washers 46 so as to frictionally restrict the rotative movement of the disc relative to link part 34. Disc 36 is located in the plane of movement of bracket 26 of the adjacent door 12,13 as the door is fully opened and has a peripheral notch 50 therein into which the side edge 52 of the bracket fits, as shown in FIG. 2. In this location of disc 36, bracket 26 serves as the catch part of the retainer member 28 with the door 12,13 being held in its open position through the frictional contact between the disc and link part 34.

Figure 5:
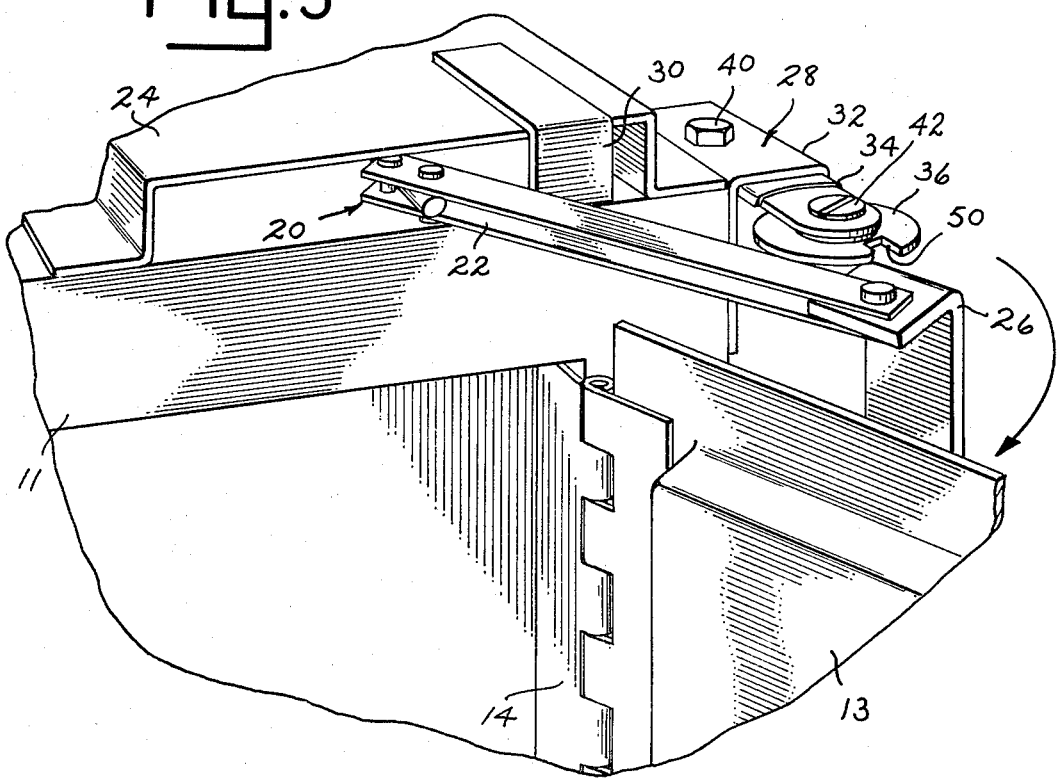
FIG. 5 is a view similar to that of FIG. 4 showing the door being released from the retainer upon closing.
Figure 4:
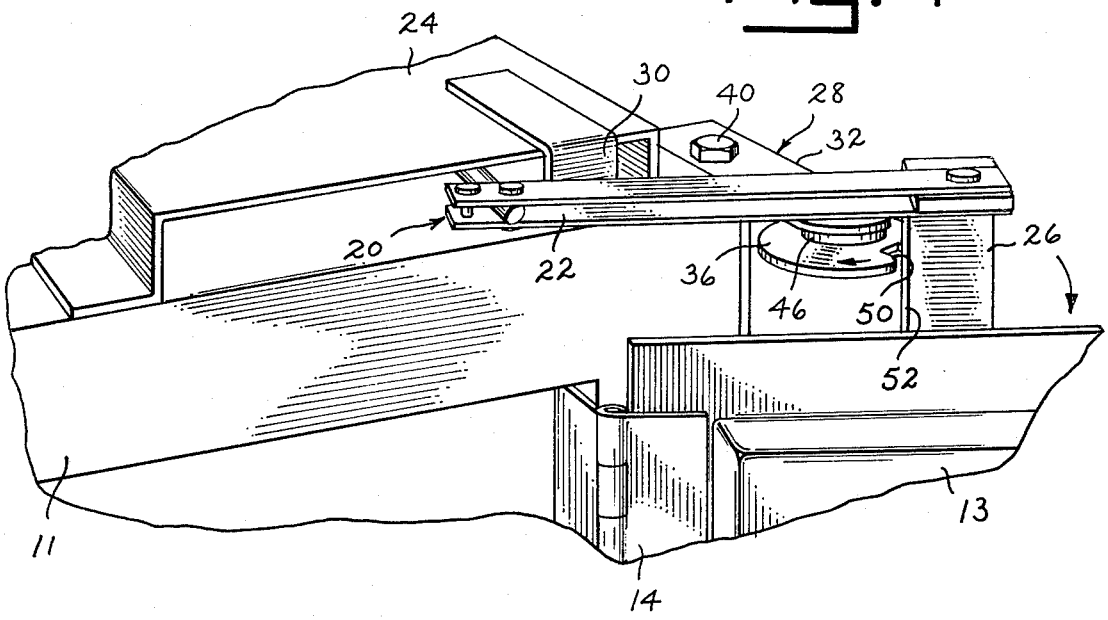
FIG. 4 is a view similar to that of FIG. 2 showing the door initially rotating towards its closed position.
Figure 6:
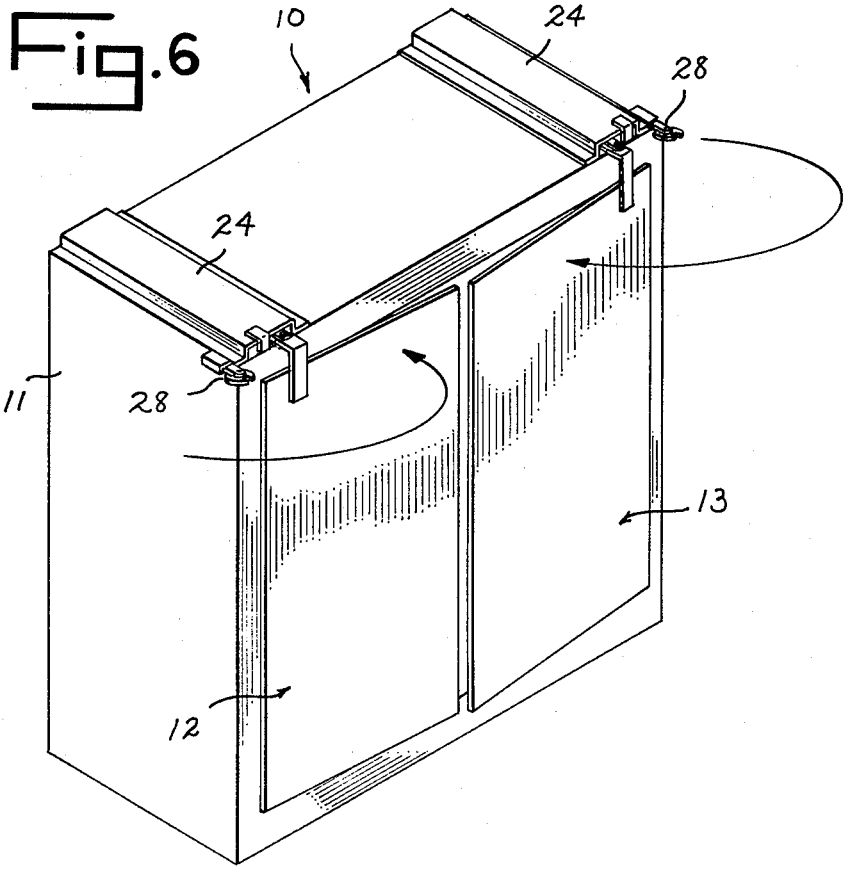
FIG. 6 is a perspective view of the cabinet of FIG. 1 with the doors nearly closed.
Figure 9:
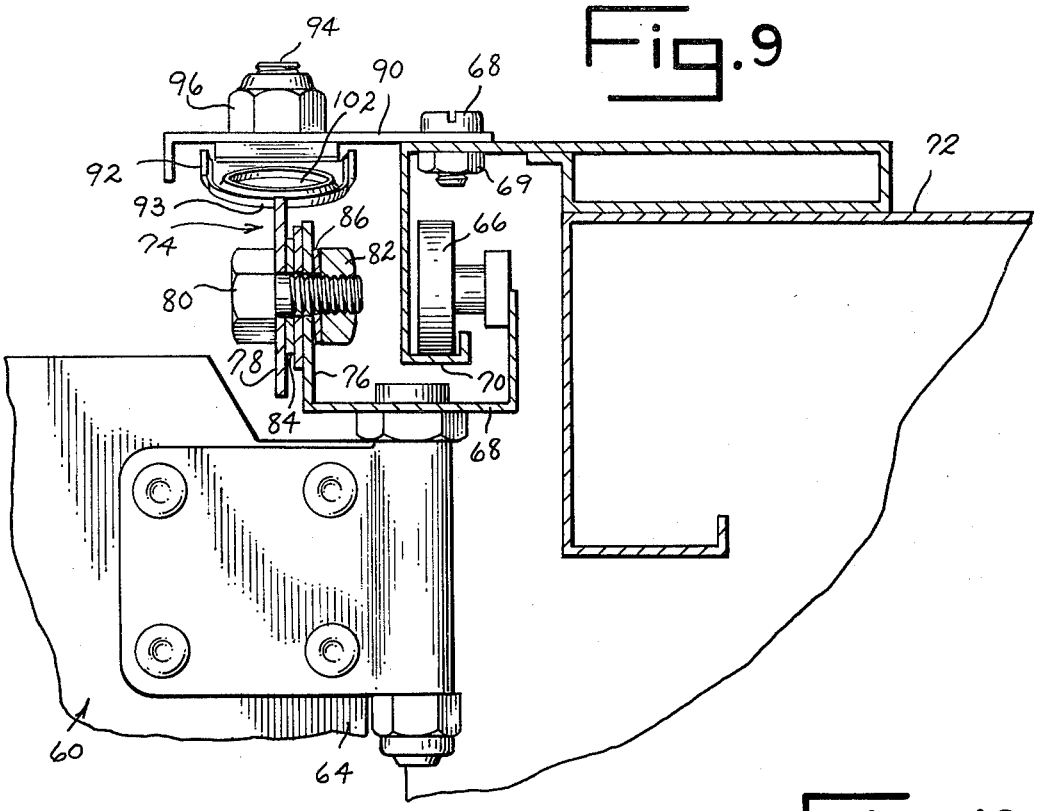
FIG. 9 is a cross-sectional view as seen through line 9—9 of FIG. 8.
Figure 10:
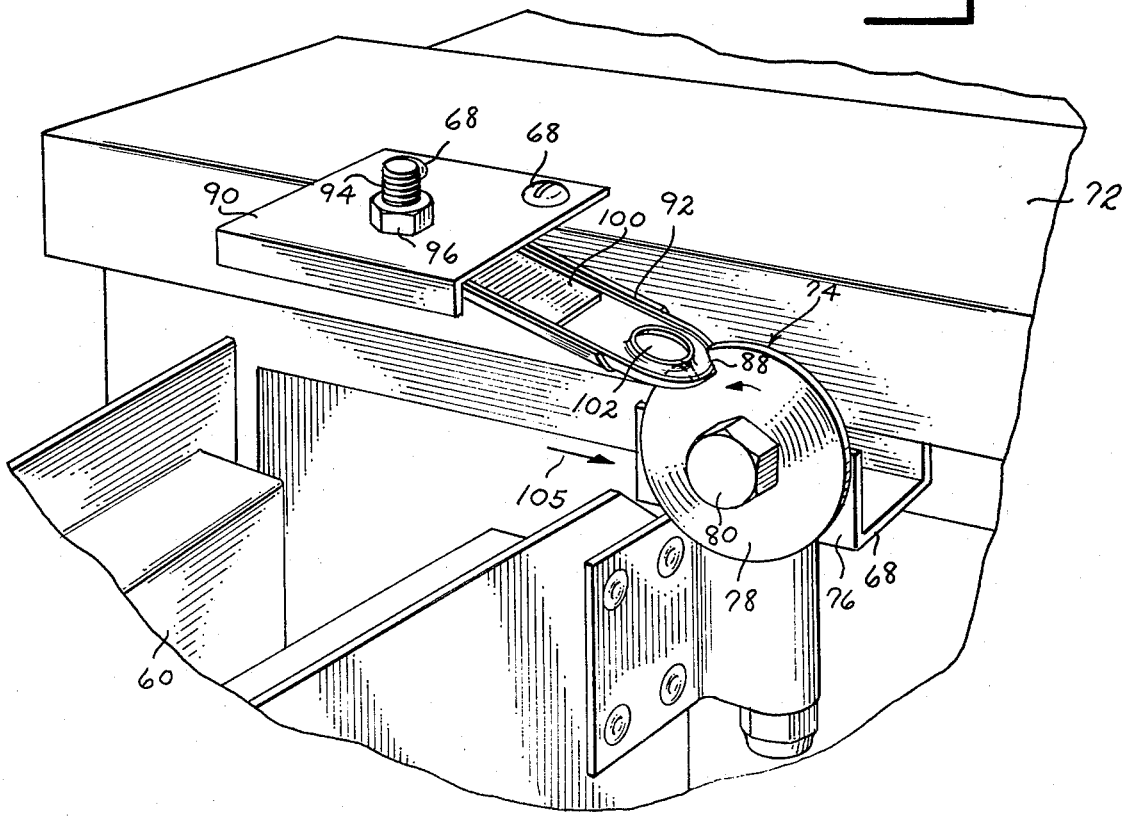
FIG. 10 is an enlarged detail view showing the door of the cabinet of FIG. 7 initially closing.

FIGS. 4, 5, and 6 sequentially illustrate the motion of disc 36 and door 12,13 as the door moves from its frictionally held open position in FIGS. 1 and 2 to a closed position shown in FIG. 6. Each door 12,13 needs to be only manually disengaged at its bracket 26 from contacting disc 36, as seen in FIG. 4, to allow for the influence of its associated closure 20 to close the door. Such application of initial manual force to the doors 12 and 13 overcomes the restraining frictional force applied to discs 36 and causes the discs to rotate relative to brackets 32. When no manual force is applied, the friction created by washers 46 on discs 36 is sufficient to counteract the closing forces applied by closures 20, thereby keeping the doors open. Through the use of retainer members 28, the links 62 used in U.S. Pat. No. 4,146,994 are not needed.

FIGS. 7-10 illustrate a second embodiment of the invention. Cabinet 58 includes a bi-fold door 60 which automatically closes under the influence of a spring biased hinge 62. The leading edge 64 of door 60 is supported by a roller 66 connected to the door by a bracket 68 and carried within a track 70 secured to cabinet frame or housing 72. A more complete description of this type cabinet is found in U.S. Pat. Re. 27,066 incorporated herein by reference.

A retainer member 74 extends between door 60 and cabinet housing 72. Retainer member 74 includes bracket 68 having a flange part 76 to which a rotatable disc 78 is pivotally connected by bolt 80, nut 82, and interdisposed bearing washer 84 and lock washer 86. A notch 88 is formed in the peripheral edge of disc 78.

A mounting bracket 90 is attached to the top of cabinet housing 72 by means of mounting screws 68 and nuts 69 and carries a fusible link 92. Fusible link 92 is connected to mounting bracket 90 by means of a bolt 94 and nut 96 and is urged away from bracket 90 toward door 60 by means of a spring 100. Link 92 is of separable form when subjected to a specific amount of heat and has an opening 102 formed in its exposed end. Link 92 at opening 102 therein is located in the plane of movement of disc 78 as door 60 is fully opened and is received within disc notch 88, as seen in FIG. 8. In this manner the link serves as the catch part of retainer member 74 with door 60 being retained in its open position. Spring 100 in contact with link 92 assists in urging the marginal edge 93 of the link into holding contact with disc 78 at its notch 88. Manual movement of door 60 from its retained open position towards its closed position as indicated by arrow 105 in FIG. 10 causes the frictional resistance between disc 78 and bracket 68 to be overcome with link 92 being freed from notch 88 of the disc. This allows door 60 to now close under the influence of its hinge spring. Through the use of retainer member 74, link 40 in U.S. Pat. Re. 27,066 is not needed.

In both retainer members 28 and 74, the notches 50 and 88 of discs 36 and 78 remain positioned after release of the doors to alignably receive bracket 26 or link 92, as the case may be, when the doors are again fully opened. Discs 36 and 78 rotate slightly when engaging with or disengaging from bracket 26 and link 92. At the presence of excessive heat, such as created by a fire, the open doors 12,13 and 60 will be released to automatically close independently of discs 36 and 78 by the separation of fusible link part 34 and link 92.

It is to be understood that the invention is not to be limited to the above given description but may be modified within the scope of the appended claims.

What I claim is:

1. In combination, a door and a retainer member for holding said door in its open position, said door connected to a frame by a hinge and being rotatable about said hinge between its said open position and a closed position, said retainer member comprising a bracket connected to one of said door and said frame, a rotatable disc part carried by said bracket, and catch means secured to the other of said door and said frame for engaging said disc part when said door is shifted to its said open position, the rotation of said disc part relative to said bracket being frictionally restrained, said disc part including an annular edge portion, said annular edge portion having a notch means therein, said notch means for accepting said catch means upon shifting said door into its said open position with said disc being frictionally restrained against rotation to thereby retain said door in such open position, said catch means being released by the rotation of said disc part during urged movement of said door from its said open to said closed position.

2. The combination of claim 1 wherein said catch means is secured to said door and said bracket is secured to said frame, said bracket being secured spacedly from the pivotal axis of said door.

3. The combination of claim 2 wherein said bracket means includes a fusible link, said disc part connected to said fusible link, said fusible link separating said disc part from the remainder of said bracket means upon the application of heat.

4. The combination of claim 1 wherein said catch means is secured to said frame and said bracket is secured to said door.

5. The combination of claim 4 wherein said catch means includes a fusible link releasably connecting said disc to the catch means when said door is in its said open position, said fusible link separating to release said door upon the application of heat.

6. The combination of claim 4 wherein said catch means includes biasing means for urging said catch means into engagement with said notch means.

* * * * *